US009352805B2

(12) United States Patent
Kawabe et al.

(10) Patent No.: US 9,352,805 B2
(45) Date of Patent: May 31, 2016

(54) OCEANOGRAPHIC INFORMATION COLLECTION SYSTEM

(71) Applicant: IHI CORPORATION, Tokyo (JP)

(72) Inventors: Aritsune Kawabe, Tokyo (JP); Takuya Omori, Tokyo (JP); Masaaki Ichikawa, Tokyo (JP); Yoshiyuki Wada, Tokyo (JP); Toshihiko Nakagawa, Tokyo (JP)

(73) Assignee: IHI Corporation, Tokyo (JP)

( * ) Notice: Subject to any disclaimer, the term of this patent is extended or adjusted under 35 U.S.C. 154(b) by 70 days.

(21) Appl. No.: 14/356,794

(22) PCT Filed: Nov. 14, 2012

(86) PCT No.: PCT/JP2012/079502
§ 371 (c)(1),
(2) Date: May 7, 2014

(87) PCT Pub. No.: WO2013/073570
PCT Pub. Date: May 23, 2013

(65) Prior Publication Data

US 2014/0302732 A1 Oct. 9, 2014

(30) Foreign Application Priority Data

Nov. 16, 2011 (JP) ..... 2011-250701

(51) Int. Cl.
*B63B 22/18* (2006.01)
*B63B 22/08* (2006.01)
(Continued)

(52) U.S. Cl.
CPC ..... *B63B 22/08* (2013.01); *B63B 21/20* (2013.01); *B63B 22/00* (2013.01); *B63B 22/04* (2013.01); *B63B 22/06* (2013.01); *B63B 22/20* (2013.01); *B63B 2211/02* (2013.01)

(58) Field of Classification Search
CPC ..... B63B 22/08; B63B 21/20; B63B 22/00; B63B 22/04; B63B 22/12; B63B 22/14; B63B 22/18; B63B 22/20; B63B 22/22; B63B 22/24; B63B 2022/00; B63B 2022/006
USPC ..... 114/343, 345; 441/1, 6, 7, 9, 10, 21, 23, 441/28, 29, 30
See application file for complete search history.

(56) References Cited

U.S. PATENT DOCUMENTS 3,226,670 A * 12/1965 Richard ..... G01S 15/101 102/341
3,674,225 A * 7/1972 Johnson ..... B63B 22/00 244/31

(Continued)

FOREIGN PATENT DOCUMENTS

CN 101549744 A 10/2009
JP 05-281354 A 10/1993

(Continued)

OTHER PUBLICATIONS

International Search Report, PCT/JP2012/079502, Feb. 8, 2013, 2 pgs.

(Continued)

*Primary Examiner* — Daniel V Venne
(74) *Attorney, Agent, or Firm* — Volpe and Koenig, P.C.

(57) ABSTRACT

An oceanographic information collection system includes an anchor arranged on a sea bottom, an intermediate buoy connected to the anchor and floating in a sea, a mooring cable connected at one end to the intermediate buoy and at another end to an observation buoy. The observation buoy includes a main body whose longitudinal direction is arranged in a flowing direction of an ocean current. A specific gravity adjuster is arranged in the main body and includes an expandable and shrinkable buoyancy bag, an antenna arranged on the main body and transfers data, and an observation unit arranged in the main body and acquires prescribed oceanographic information. The observation buoy floats upward by expanding the buoyancy bag of the specific gravity adjuster, and sinks by shrinking the buoyancy bag in order to stand by in the sea. The buoy can easily float, sink and stand by in the sea.

6 Claims, 6 Drawing Sheets

(51) Int. Cl.

| | |
|---|---|
| ***B63B 21/20*** | (2006.01) |
| ***B63B 22/00*** | (2006.01) |
| ***B63B 22/04*** | (2006.01) |
| ***B63B 22/06*** | (2006.01) |
| ***B63B 22/20*** | (2006.01) |

(56) References Cited

U.S. PATENT DOCUMENTS

| | | | | |
|---|---|---|---|---|
| 3,906,565 | A * | 9/1975 | Dorrance | B63B 22/18 441/22 |
| 3,936,895 | A | 2/1976 | Talkington | |
| 4,177,530 | A | 12/1979 | Swenson | |
| 4,999,816 | A * | 3/1991 | Dale | G10K 11/006 367/165 |
| 5,283,767 | A * | 2/1994 | McCoy | B63B 22/20 114/331 |
| 2012/0204775 | A1 | 8/2012 | Watanabe et al. | |

FOREIGN PATENT DOCUMENTS

| | | | |
|---|---|---|---|
| JP | 6-133371 | A | 5/1994 |
| JP | 2739534 | B2 | 4/1998 |
| JP | 2001-151474 | A | 6/2001 |
| JP | 2006-160025 | A | 6/2006 |
| JP | 2012-532267 | A | 12/2012 |
| WO | 2011/008351 | A1 | 1/2011 |
| WO | 2011/052647 | A1 | 5/2011 |

OTHER PUBLICATIONS

Australian Office Action, Australian Application No. 2012337863, Apr. 29, 2015, 5 pgs.

Extended European Search Report, European Patent Application No. 12849129.7, Nov. 23, 2015, 7 pgs.

* cited by examiner

OCEANOGRAPHIC INFORMATION COLLECTION SYSTEM

FIELD OF INVENTION

The present invention relates to an oceanographic information collection system and, in particular, to an oceanographic information collection system suitable for fixed-point observation.

BACKGROUND

It is said that the sea covers about 70% of the earth surface, and has a thermal capacity about 1000 times as much as that of the atmosphere. Accordingly, large variations in temperature of seawater greatly affect the state of the atmosphere and largely change the climate and weather all over the world (e.g., El Nino etc.). To address this, various effects on the earth can be predicted and prevented by collecting oceanographic internal information including the temperature of seawater and grasping variation in oceanographic information. Several proposals have already been made as systems for collecting such oceanographic information (e.g., see Patent Literatures 1 and 2).

Patent Literature 1 discloses a system that collects oceanographic information using a movable unit that periodically sinking and floating upward repeatedly. This system is configured such that prescribed observation is performed during upward floating of the movable unit, and observation data is transmitted to the outside when the unit reaches the surface of the sea. The movable unit includes an adjustable ballast receiver. The volume of the adjustable ballast receiver is increased or reduced by injecting and draining ballast oil into and from the adjustable ballast receiver. The specific gravity of the movable unit is adjusted by changing in volume of the movable unit in the sea. Thus, change in volume of the adjustable ballast receiver adjusts the specific gravity of the movable unit, thereby allowing the movable unit to float upward and sink at a desired speed. An oceanographic information collection system disclosed in Patent Literature 1 can be referred to as a drift observation type, because the movable unit is not moored to the sea bottom.

Patent Literature 2 discloses a system in which a long-term observation station for collecting oceanographic information is arranged at a deep sea depth, and a data transmission buoy that periodically floats upward and sinks in a repeated manner transmits observation data to a ground base, thereby collecting oceanographic information. In this system, the data transmission buoy has a configuration capable of floating and sinking by means of a winch driving device installed at a relay base or a long-term observation station. In the oceanographic information collection system disclosed in Patent Literature 2, the long-term observation station is moored to the sea bottom. Accordingly, this system can be referred to as a fixed-point observation system.

CITATION LIST

Patent Literature

Patent Literature 1: Japanese Patent No. 2739534

Patent Literature 2: Japanese Laid-Open Patent publication No. 06-133371

SUMMARY

Technical Problem

In the drift observation type oceanographic information collection system as described in Patent Literature 1, movement of the movable unit depends on an ocean current. Accordingly, the system cannot necessarily acquire data at required sites. Therefore, in order to periodically acquire oceanographic information at required sites, the number of movable units should be increased. At present, at least 3000 drift observation type movable units are drifting in the ocean. These movable units are basically disposable, and will finally become ocean debris. It is not impossible to collect used movable units. However, efforts therefor are enormous.

In the fixed-point observation type oceanographic information collection system as described in Patent Literature 2, the installation sites are identified. Accordingly, buoys can be easily collected or replaced, thereby facilitating reduction in ocean debris. However, in the fixed-point observation type oceanographic information collection system, deployment of a buoy always on the surface causes problems in that maritime traffic and fishing activity are disturbed and living things, such as shellfish, are attached. One of measures thereagainst is a method of a buoy to float and sink. Means for driving a buoy to float and sink is required to be submerged in the sea, which causes problems of making the mechanism complicated, increasing cost and often causing failures. The fixed-point observation that sets long-term observation stations at a deep sea depth has a problem of difficulty in acquiring oceanographic information at a shallow depth, which easily affects the atmosphere, and oceanographic information in accordance with the depth.

The present invention has been made in view of the foregoing problems. It is an object of the present invention to provide an oceanographic information collection system that the buoy can easily float, sink and stand by in the sea.

Solution to Problem

The present invention provides a configuration of an oceanographic information collection system, including an anchor arranged on a sea bottom; an intermediate buoy that is connected to the anchor and floats in a sea; a mooring cable connected at one end to the intermediate buoy; and an observation buoy connected to another end of the mooring cable, wherein the observation buoy includes: a main body whose longitudinal direction is arranged in a flowing direction of an ocean current; a specific gravity adjuster that is arranged in the main body and includes an expandable and shrinkable buoyancy bag; an antenna that is arranged on the main body and transfers data; and an observation unit that is arranged in the main body and acquires prescribed oceanographic information, and the observation buoy floats upward by expanding the buoyancy bag of the specific gravity adjuster, and the observation buoy sinks by shrinking the buoyancy bag of the specific gravity adjuster to be made to stand by in the sea.

Preferably, the mooring cable is configured to be connected at a position that is more forward than a center of a total length of the observation buoy and more rearward than a fore-end.

Preferably, the observation buoy is configured such that the specific gravity adjuster is arranged at a fore-end of the main body, and the antenna and the observation unit are arranged at an aft-end of the main body.

Preferably, the intermediate buoy is configured to float at a depth equivalent to an undersea standby position of the observation buoy.

Preferably, a configuration is adopted that further includes lift generation means arranged on the mooring cable, wherein the lift generation means assists upward floating and sinking of the observation buoy.

Preferably, a configuration is adopted where the lift generation means is a float that includes an openable and closable wing member and can float in the sea, or a sleeve which includes a flange having an enlarged width and into which the mooring cable is inserted.

Advantageous Effects of Invention

The foregoing oceanographic information collection system of the present invention can cause the observation buoy to stand by in the sea without winding the mooring cable, and easily float and sink only by expanding and shrinking the buoyancy bag. Connection of the observation buoy to the anchor via the intermediate buoy can achieve fixed-point observation, easily collect and replace the observation buoy, and suppress increase in ocean debris. Furthermore, since oceanographic information is thus to be collected by the floatable and sinkable observation buoy, oceanographic information at a shallow sea depth that easily affects the atmosphere and oceanographic information through multi-point observation in accordance with the depth can be easily collected.

Furthermore, the lift generation means is arranged on the mooring cable. This arrangement can reduce the tension of the mooring cable that prevents the observation buoy from floating upward due to the ocean current, and smoothly float the observation buoy upward.

DETAILED DESCRIPTION OF THE PREFERRED EMBODIMENTS

Figure 1:
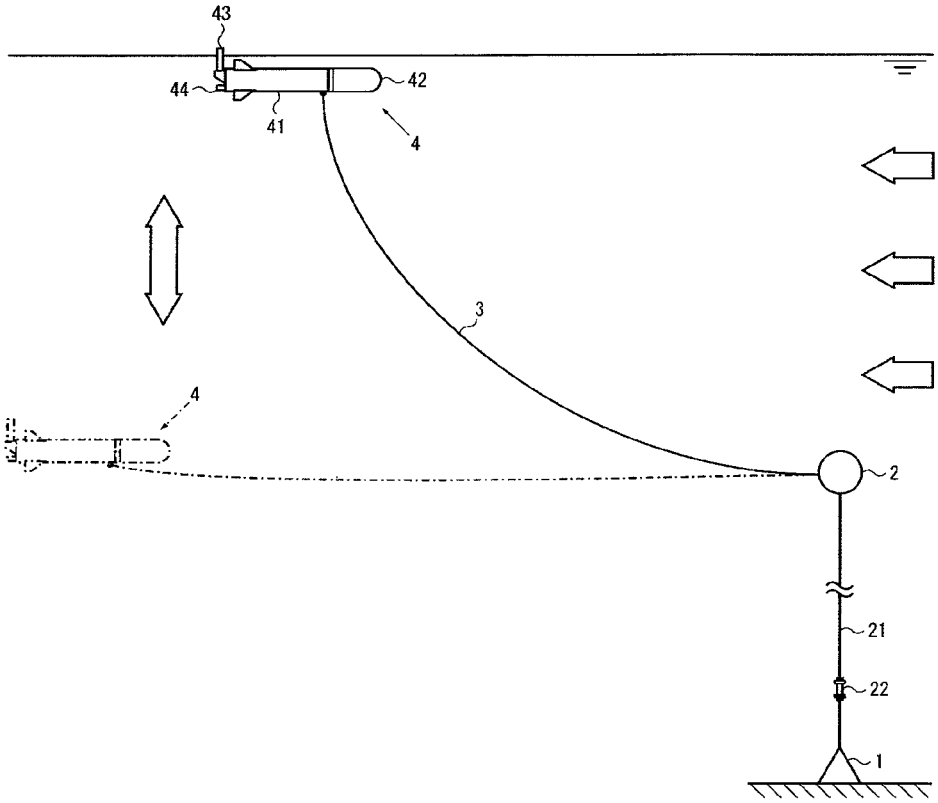
FIG. 1 is an overall configuration diagram showing an oceanographic information collection system according to a first embodiment of the present invention.
Figure 2A:
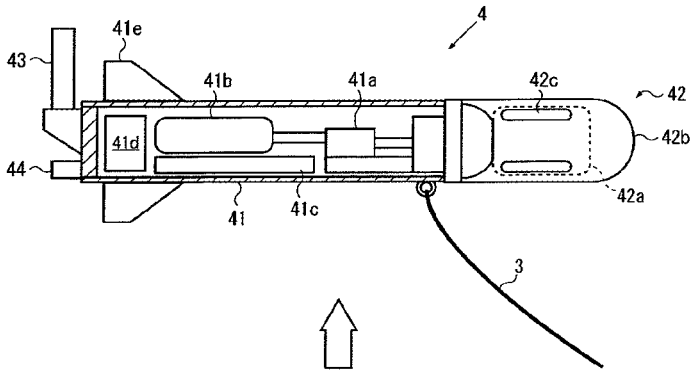
FIG. 2A is a detailed diagram of an observation buoy shown in FIG. 1 in a floating state.
Figure 2B:
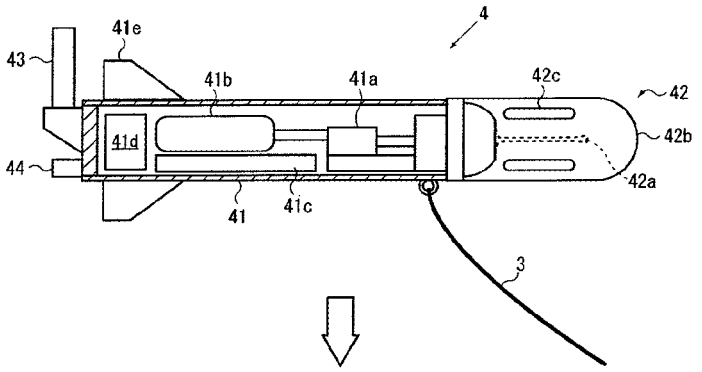
FIG. 2B is a detailed diagram of the observation buoy shown in FIG. 1 in a sinking state.

Embodiments of the present invention are hereinafter described with reference to FIGS. 1 to 6B. Here, FIG. 1 is an overall configuration diagram showing an oceanographic information collection system according to a first embodiment of the present invention. FIGS. 2A and 2B are detailed diagrams of an observation buoy shown in FIG. 1. FIG. 2A shows a floating state. FIG. 2B shows a sinking state.

As shown in FIGS. 1, 2A and 2B, the oceanographic information collection system according to the first embodiment of the present invention includes an anchor 1 arranged on the sea bottom, an intermediate buoy 2 that is connected to the anchor 1 and floats in the sea, a mooring cable 3 connected at one end to the intermediate buoy 2, and an observation buoy 4 connected to another end of the mooring cable 3, wherein the observation buoy 4 includes, a main body 41 whose longitudinal direction is arranged in the flowing direction of an ocean current indicated by solid white arrows in FIG. 1, a specific gravity adjuster 42 that is arranged in the main body 41 and includes an expandable and shrinkable buoyancy bag 42*a*, an antenna 43 that is arranged on the main body 41 and transfers data, and an observation unit 44 that is arranged in the main body 41 and acquires prescribed oceanographic information, and the observation buoy 4 floats upward by expanding the buoyancy bag 42*a* of the specific gravity adjuster 42, and the observation buoy 4 sinks by shrinking the buoyancy bag 42*a* of the specific gravity adjuster 42 to be made to stand by in the sea.

The anchor 1 is a component for mooring the observation buoy 4 to the sea bottom. The anchor 1 may be, for instance, a placement type weight having a certain weight preventing movement due to an ocean current, or what is fixed to the sea bottom using a stake or the like. The anchor 1 is arranged on the sea bottom in an area where oceanographic information is intended to be acquired.

The intermediate buoy 2 is a component configuring a starting point of floating and sinking of the observation buoy 4. The intermediate buoy 2 is connected to the anchor 1 by a mooring cable 21. An underwater cutoff device 22 is arranged at an intermediate part of the mooring cable 21. The underwater cutoff device 22 facilitates installation and collection of the intermediate buoy 2. The intermediate buoy 2 has buoyancy for allowing this buoy 2 to float at a position on a substantially vertical position with respect to the anchor 1.

The intermediate buoy 2 may be configured to float at a depth equivalent to the undersea standby position of the observation buoy 4. For instance, in the case where the depth at which the anchor 1 is arranged is about 2000 m and the depth of the undersea standby position of the observation buoy 4 is about 1000 m, the floating depth of the intermediate buoy 2 is set to about 1000 m. Such setting of the floating depth of the intermediate buoy 2 to be equivalent to the undersea standby position of the observation buoy 4, arranges the mooring cable 3 to be substantially parallel to the ocean current in the standby state of the observation buoy 4. The arrangement can suppress occurrence of tension of the mooring cable 3 to the observation buoy 4 in the standby state, thereby allowing the standby position and attitude of the observation buoy 4 to be stable. Note that "equivalent" indicates a substantially identical depth and includes an error of about ±100 m.

During floating of the observation buoy 4 to the surface or in the sea, objects, such as ice bergs and flotage, sometimes drift nearby. In this case, in order to suppress failures or breakage, it is preferred to temporarily sink the observation buoy 4 and avoid these objects. At this time, the observation buoy 4 temporarily stays at an avoidance position. This position may be different from the undersea standby position, that is, a position shallower than the floating depth of the intermediate buoy 2.

The mooring cable 3 is a component for connecting the intermediate buoy 2 to the observation buoy 4. The length of the mooring cable 3 is set to allow the observation buoy 4 to float upward and reach the surface of the sea on the basis of conditions including the depth of the undersea standby position of the observation buoy 4, the speed of the ocean current in which the observation buoy 4 is arranged, and the magnitude of resistance of the mooring cable 3 against the ocean current. The mooring cable 3 may be made of reinforced plastic material having, for instance, a diameter of 5 mm or less, and the specific gravity may be equal to the specific gravity of seawater such that the cable can achieve supporting capability and float and sink by a small number of strands (e.g., one). The mooring cable 3 is connected at a position that is more forward than the center of the total length of the observation buoy 4 and more rearward than the fore-end. Connection of the mooring cable 3 at this position allows the observation buoy 4 to be easily supported substantially parallel to the flowing direction of the ocean current. Specifically, the mooring cable 3 is connected to, for instance, the fore-end of the main body 41.

The observation buoy 4 is a component that floats and sinks in an area where oceanographic information is intended to be acquired, and acquires prescribed oceanographic information. The main body 41 is a container that has a cylindrical shape and forms a sealed space. The inner space accommodates an oil pump 41*a* that injects and drains hydraulic fluid (e.g., silicone oil) into and from the buoyancy bag 42*a*, an oil tank 41*b* that stores the hydraulic fluid, a battery pack 41*c* that supplies power to electronic devices, and a controller 41*d* that controls the antenna 43 and the observation unit 44. The main body 41 has a elongate shape so as to be able to maintain an attitude (e.g., the angle of incidence ranging from 0 to 45°) substantially parallel to the ocean current, and is arranged such that the longitudinal direction is along the flowing direction of the ocean current. This arrangement of the longitudinal direction of the observation buoy 4 in the flowing direction of the ocean current can reduce a pressure-receiving area of the observation buoy 4 that receives the ocean current. Stabilization wings 41*e* that holds the attitude of the observation buoy 4 in the ocean current may be arranged at the aft-end of the main body 41.

The observation buoy 4 includes the specific gravity adjuster 42 arranged fore of the main body 41, and the antenna 43 and the observation unit 44 arranged aft of the main body 41. The observation buoy 4 is connected to the mooring cable 3, and drifted by the ocean current. Accordingly, the buoy typically has characteristics that the downstream side tends to float more easily than the upstream side does. Thus, the antenna 43, which is intended to be exposed above the surface of the sea, is arranged at the aft-end of the main body 41, and the specific gravity adjuster 42, which urges the observation buoy 4 to float or sink, is arranged at the fore-end of the main body 41. According to analogous reasons, the oil tank 41*b* is arranged on the aft-end side of the main body 41. In order to facilitate wiring and the like, the observation unit 44 and the controller 41*d* are arranged in a combined manner at a position in proximity to the antenna 43.

The specific gravity adjuster 42 includes the expandable and shrinkable buoyancy bag 42*a*, a cover 42*b* covering the periphery of the buoyancy bag 42*a*, and the oil pump 41*a* arranged in the main body 41. The buoyancy bag 42*a* is made of soft material resistant to seawater (e.g., resin etc.). The cover 42*b* is a component for suppressing breakage of the buoyancy bag 42*a*, and has a plurality of openings 42*c* formed on the periphery. Accordingly, the cover 42*b* is in a state of being filled with seawater.

When the oil pump 41*a* is operated to inject hydraulic fluid into the buoyancy bag 42*a*, the buoyancy bag 42*a* expands in the cover 42*b* to push seawater in the cover 42*b* out of the openings 42*c* into the sea as shown in FIG. 2A. As a result, the apparent volume of the observation buoy 4 is increased, and the specific gravity of the observation buoy 4 is reduced, thereby increasing the buoyancy. Accordingly, the observation buoy 4 can float upward.

When the oil pump 41*a* is operated to drain the hydraulic fluid from the buoyancy bag 42*a*, the buoyancy bag 42*a* shrinks in the cover 42*b* to allow seawater to flow into the cover 42*b* from the openings 42*c* as shown in FIG. 2B. As a result, the apparent volume of the observation buoy 4 is reduced, and the specific gravity of the observation buoy 4 is increased, thereby reducing the buoyancy. Accordingly, the observation buoy 4 can sink. The operation of the oil pump 41*a* is performed by, for instance, the controller 41*d*.

The antenna 43 is a component that transmits oceanographic data acquired by the observation unit 44 to a main apparatus, such as a ground base station or an observation vessel. The antenna 43 may directly communicate with the antenna of the main apparatus or communicate with the main apparatus via a communication satellite.

The observation unit 44 is a component for collecting prescribed oceanographic information. The observation unit 44 includes a CTD sensor for acquiring basic information including e.g., salinity (a sensor for measuring conductivity, temperature, and depth), and a water sampler for sampling seawater, and further includes various sensors and devices for measurement and observation, such as a pressure sensor, a magnetic sensor, a radioscope, and a sonar. These sensors and devices are appropriately selected according to oceanographic information to be intended to be acquired in an area for fixed-point observation. Oceanographic information acquired by the observation unit 44 is stored in a storing unit (memory) arranged in the controller 41*d*. The storing unit (memory) stores an operation schedule of the sensors and the like in the observation unit 44 and a floating and sinking schedule of the observation buoy 4. According to these schedules, the controller 41*d* performs prescribed operations required for measurement and floating and sinking.

The observation unit 44 may acquire data, for instance, during floating of the observation buoy 4 toward the surface, or acquire data in a state of standby in the sea. The oceanographic data acquired by the observation unit 44 may be periodically transmitted from the antenna 43 when the observation buoy 4 floats to the surface of the sea, or continuously stored in the storing unit (memory) until the observation buoy 4 is collected. The arrangement of the observation unit 44 is not limited to that at the aft-end of the main body 41. Alternatively, any arrangement may be adopted according to the types and sizes of sensors and devices to be arranged. For instance, the unit may be on a side or bottom surface of the main body 41.

Next, operations of the oceanographic information collection system according to the foregoing first embodiment are described. As shown in FIG. 1, the anchor 1 is arranged on the sea bottom in an area where oceanographic information is intended to be acquired. Specifically, the observation buoy 4 is arranged downstream of the anchor 1 in the ocean current (indicated by solid white arrows). Accordingly, the arrangement position of the anchor 1 is set so as to arrange the observation buoy 4 in the area where oceanographic information is intended to be acquired, in consideration of the speed, variation and the like of the ocean current. The depth of the anchor 1 typically ranges from several hundreds to several thousands of meters.

As shown in the drawing, the observation buoy 4 floats and sinks with reference to the intermediate buoy 2 as a starting point. Here, the floating state is represented by solid lines, and the sinking state is represented by alternate long and short dashed lines. Expansion of the buoyancy bag 42*a* reduces the specific gravity of the observation buoy 4 to float the observation buoy 4 upward. The observation buoy 4 finally reaches the surface of the sea, and the antenna 43 is exposed above the surface of the sea. On the basis of the depth measured by the CTD sensor of the observation unit 44, it can be grasped whether the observation buoy 4 reaches the surface of the sea or not. After the observation buoy 4 reaches the surface of the sea, required oceanographic information is transmitted from the antenna 43.

After completion of the data transmission, the observation buoy 4 is returned to the undersea standby position. Specifically, shrinkage of the buoyancy bag 42*a* increases the specific gravity of the observation buoy 4 to sink the observation buoy 4. The observation buoy 4 finally reaches the undersea standby position. At this time, the depths of the intermediate buoy 2 and the undersea standby position are set at equivalent levels. Accordingly, the mooring cable 3 is deployed in the sea in a state substantially parallel to the flowing direction of the ocean current. Therefore, the pressure-receiving area of the mooring cable 3 in which the ocean current is received can be reduced, the tension to be caused at the mooring cable 3 can be reduced, and the standby state of the observation buoy 4 can be stabilized. The standby depth in the sea of the observation buoy 4 approximately ranges, for instance, from several tens to 1000 m.

Any floating and sinking schedule of the observation buoy 4 may be set according to the place where fixed-point observation is performed, types of oceanographic information to be acquired, and the like. The schedule may be every several days, every several hours, or every several tens of minutes. It is not necessarily to transmit the entire data. A part of oceanographic data not to be transmitted may be collected after collection of the observation buoy 4. The oceanographic information collected on the ground base station, observation vessel or the like may be displayed on a screen and analyzed according to prescribed processes.

The oceanographic information collection system according to the foregoing embodiment can cause the observation buoy 4 to stand by in the sea without winding the mooring cable 3, and easily float and sink only by expanding and shrinking the buoyancy bag 42*a*. The connection of the observation buoy 4 to the anchor 1 via the intermediate buoy 2 can facilitate fixed-point observation, easily collect and replace the observation buoy 4, and suppress increase in ocean debris. Furthermore, since oceanographic information is thus to be collected by the floatable and sinkable observation buoy 4, oceanographic information at a shallow sea depth that easily affects the atmosphere and oceanographic information through multi-point observation in accordance with the depth can be easily collected.

Figure 3:
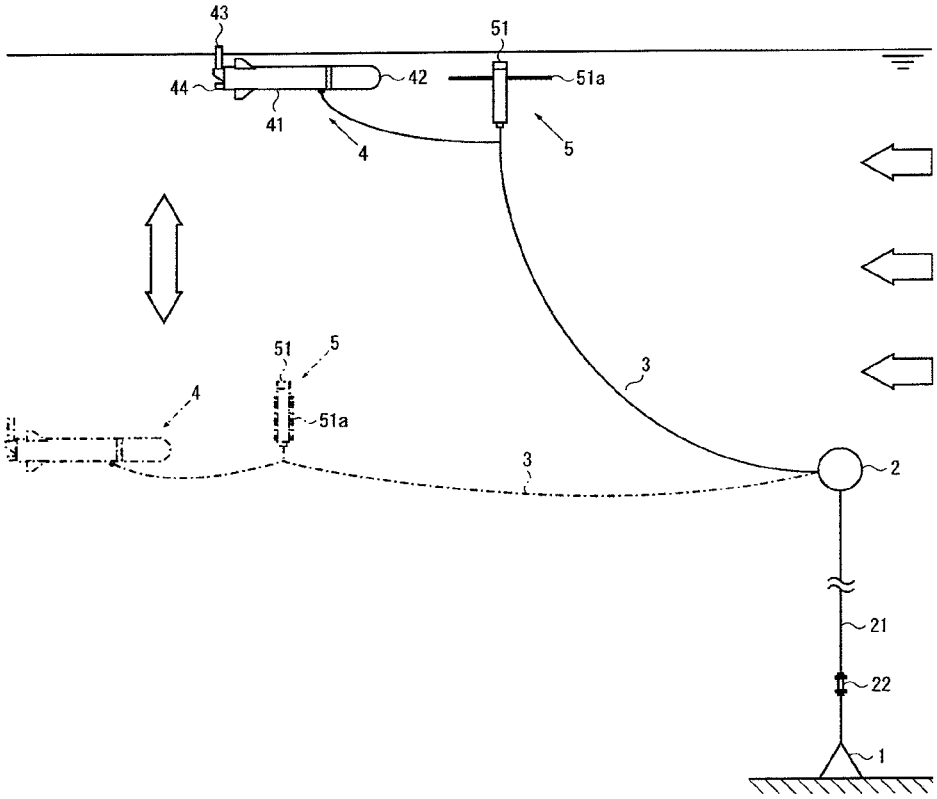
FIG. 3 is an overall configuration diagram showing an oceanographic information collection system according to a second embodiment of the present invention.
Figure 4A:
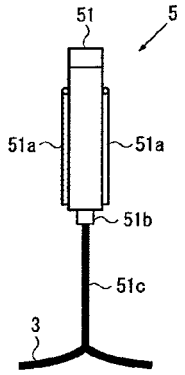
FIG. 4A is a detailed diagram of lift generation means shown in FIG. 3 in the sinking state.
Figure 4B:
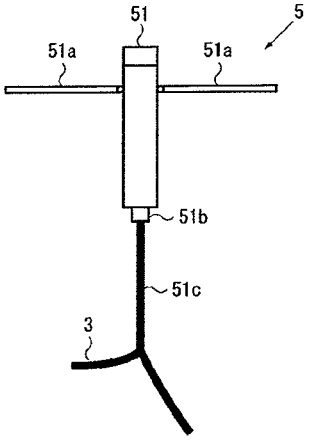
FIG. 4B is a detailed diagram of the lift generation means shown in FIG. 3 in the floating state.

Subsequently, an oceanographic information collection system according to a second embodiment of the present invention is described. Here, FIG. 3 is an overall configuration diagram showing the oceanographic information collection system according to the second embodiment of the present invention. FIGS. 4A and 4B are detailed diagrams of lift generation means shown in FIG. 3. FIG. 4A shows the sinking state. FIG. 4B shows the floating state. The same signs are assigned to configurational components identical to those of the foregoing first embodiment, and redundant description is omitted.

The oceanographic information collection system according to the second embodiment shown in FIG. 3 includes lift generation means 5 arranged on the mooring cable 3. The lift generation means 5 assists floating upward or sinking of the observation buoy 4. The mooring cable 3 typically drifts downstream owing to effects of an ocean current. While the observation buoy 4 tends to float upward, tension preventing the floating occurs. Accordingly, if the speed of the ocean current (indicated by solid white arrows) is high, it is predicted that the observation buoy 4 requires time to reach the surface of the sea or cannot reach the surface of the sea. Unfortunately, adjustment of the tension (resistance) of the mooring cable 3 through the buoyancy of the observation buoy 4 requires increase in size of the buoyancy bag 42*a*, which increases the volume of the hydraulic fluid and, in turn, increases the weight of the main body 41, thereby increasing in size of the observation buoy 4. Thus, in this embodiment, at least the lift generation means 5 for assisting the mooring cable 3 in floating upward is arranged on the mooring cable 3.

As shown in FIGS. 4A and 4B, the lift generation means 5 may be, for instance, a float 51 that includes wing members 51*a* that can open and close and can float in the sea. If the observation buoy 4 is in the state of standby in the sea as shown in FIG. 4A, the float 51 is in a state where the wing members 51*a* are closed and this float is floating in the sea. If the float 51 is too heavy to hold the floating state, the float 51 sinks below the mooring cable 3 in the state of standby in the sea. Accordingly, the mooring cable 3 is bent to sink the observation buoy 4 affected by the ocean current, and the state of standby in the sea cannot be stabilized. To address this, the float 51 is configured to have buoyancy capable of holding the state of floating to an extent that does not largely bend the mooring cable 3 in the state where the wing members 51*a* are closed. In contrast, if the buoyancy is too large, the mooring cable 3 is partially lifted. Thus, for instance, the specific gravity of the float 51 may have a specific gravity slightly smaller than that of the mooring cable 3. In consideration of these points, the float 51 is configured to have, for instance, a neutral buoyancy or slightly lower than the neutral buoyancy. This configuration allows the float 51 to be always positioned above the mooring cable 3, and can suppress entanglement of the mooring cable 3.

The main body of the float 51 has, for instance, a substantially cylindrical shape to reduce the resistance in the state of standby in the sea. In order to hold the attitude of the float 51 in the sea, the sectional shape may be streamline, or fins (straightening vanes) may be arranged on the periphery. A connection fitting 51*b* is arranged at the bottom of the float 51. A branch cable 51*c* branched from the mooring cable 3 is connected to the connection fitting 51*b*. The connection fitting 51*b* may be, for instance, a swivel joint so as to allow the branch cable 51*c* to move freely. Here, the case where only one float 51 is arranged is shown. Alternatively, a plurality of floats 51 may be arranged on the mooring cable 3 according to the ocean current speed and the standby depth.

As shown in FIG. 4B, during floating upward of the observation buoy 4, the wing members 51*a* are opened to increase the pressure-receiving area that receives the ocean current, thereby generating a lift. The wing members 51*a* may have a curved shape to increase the pressure-receiving area. The main body of the float 51 contains an open and close driving device (not shown) for the wing members 51*a*. The open and close driving device may have any mechanism only if the mechanism can output power capable of extending the wing members 51*a* against the water pressure at the depth in the state of standby in the sea. For instance, the mechanism may be an electric motor generating rotational movement, a combination of the electric motor and a gear mechanism, an actuator generating reciprocating movement or a combination of the actuator and a cam mechanism.

Power to the open and close driving device may be supplied from a battery embedded in the main body of the float 51, or from the battery pack 41*c* embedded in the observation buoy 4. In the case of supplying power from the observation buoy 4, the mooring cable 3 and the branch cable 51*c* may be power cables, or power cables are required to be additionally provided along the mooring cable 3 and the branch cable 51*c*. The open and close schedule control on the wing members 51*a* may be performed by a control device embedded in the main body of the float 51, or by the controller 41*d* embedded in the observation buoy 4. Alternatively, the control may be performed by arranging a mechanism for transmitting and receiving radio waves, such as ultrasonic waves, and by causing control signals to be transmitted from the outside. Instead, the open and close angles of the wing members 51*a* or the angles of incidence may be controlled according to conditions, such as the ocean current speed and the depth during floating upward.

Here, operations of the oceanographic information collection system according to the foregoing second embodiment are described.

In FIG. 3, the floating state of the observation buoy 4 is represented by solid lines, and the sinking state is represented by alternate long and short dashed lines.

In the state of standby in the sea of the observation buoy 4, the wing members 51*a* are closed, and the float 51 floats in the sea in the state of being held at a depth substantially identical to that of the observation buoy 4. If the observation buoy 4 floats upward, the hydraulic fluid is injected into the buoyancy bag 42*a* and the wing members 51*a* of the float 51 are opened, thereby generating a lift. These operations may be controlled to start at the same time or operate at different times, depending on conditions, such as the standby depth in the sea and the upward floating speed of the observation buoy 4, and the ocean current speed.

The float 51 with the wing members 51*a* being opened receives the ocean current at the wing members 51*a* to generate a lift, which lifts the mooring cable 3. The lift of the float 51 is set larger than the buoyancy of the observation buoy 4. This setting allows the float 51 floats upward leading the floating of the observation buoy 4, and can suppress generation of a tension of the mooring cable 3 pulling the observation buoy 4 downward. Even if the lift of the float 51 is equivalent to or a little smaller than the buoyancy of the observation buoy 4, the upward floating of the float 51 can pull up the mooring cable 3 in accordance with the upward floating of the observation buoy 4, and suppress generation of a tension of the mooring cable 3 pulling the observation buoy 4 downward. If the float 51 is exposed above the surface of the sea, this float may broken by wave forces or the lift cannot stabilized. Thus, the float is adjusted to finally reach a position around the surface of the sea.

After the observation buoy 4 has completed data transmission, the observation buoy 4 shrinks the buoyancy bag 42*a* and sinks in the sea. At this time, the float 51 closes the wing members 51*a* to finish generation of the lift so as not to prevent sinking of the observation buoy 4. The float 51 with the wing members 51*a* being folded up sinks in the sea in accordance with sinking of the observation buoy 4. Finally, the observation buoy 4 reaches the undersea standby position and floats there, and the float 51 floats at a position above the mooring cable 3.

In the oceanographic information collection system according to the foregoing second embodiment, the lift generation means 5 is arranged on the mooring cable 3. This arrangement can suppress generation of the tension of the mooring cable 3 that prevents the observation buoy 4 from floating upward owing to the ocean current, and smoothly float the observation buoy 4 upward.

Figure 5:
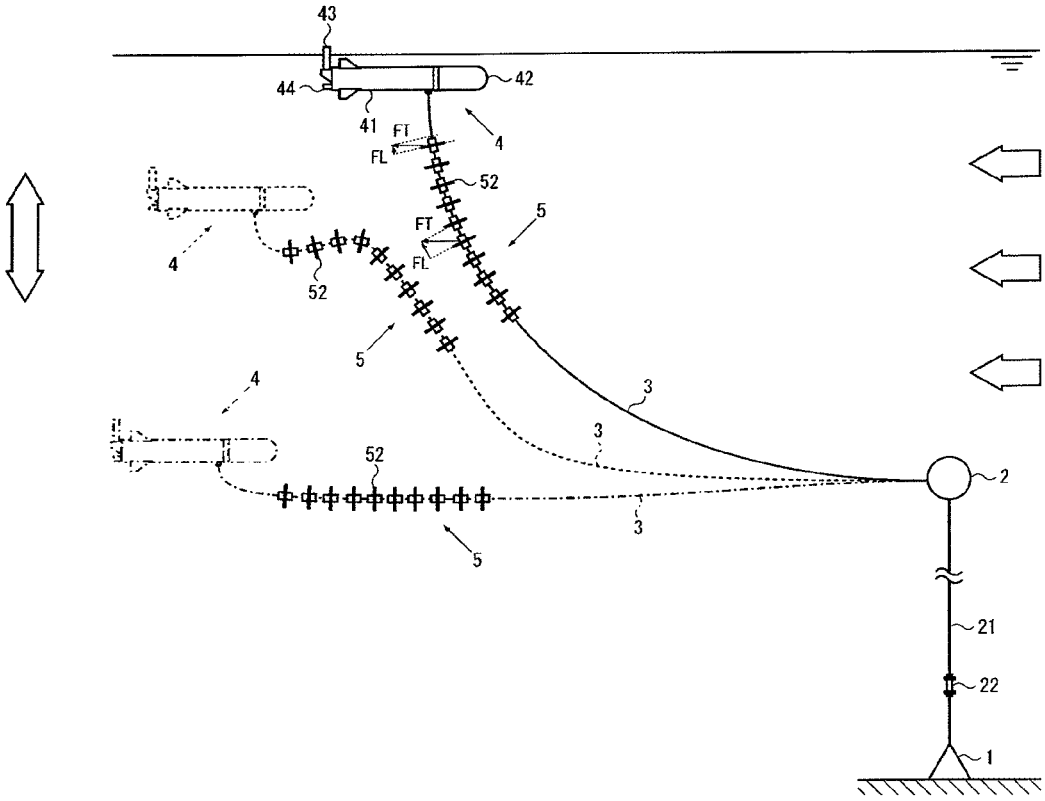
FIG. 5 is an overall configuration diagram showing an oceanographic information collection system according to a third embodiment of the present invention.
Figure 6A:
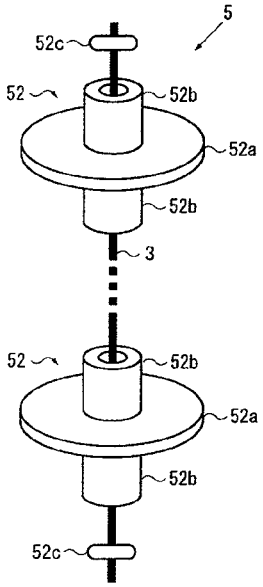
FIG. 6A is a detailed diagram of a first example of lift generation means shown in FIG. 5.
Figure 6B:
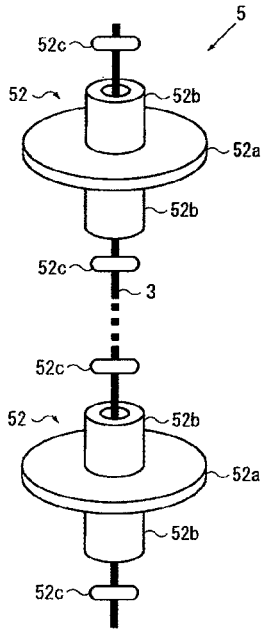
FIG. 6B is a detailed diagram of a second example of the lift generation means shown in FIG. 5.

Subsequently, an oceanographic information collection system according to a third embodiment of the present invention is described. Here, FIG. 5 is an overall configuration diagram showing the oceanographic information collection system according to the third embodiment of the present invention. FIGS. 6A and 6B are detailed diagrams of the lift generation means shown in FIG. 5. FIG. 6A shows a first example. FIG. 6B shows a second example. The same signs are assigned to configurational components identical to those of the foregoing first and second embodiments, and redundant description is omitted.

The oceanographic information collection system according to the third embodiment shown in FIG. 5 includes the lift generation means 5 as with the foregoing second embodiment. The lift generation means 5 shown in FIGS. 5, 6A and 6B include a sleeve 52 which includes a flange 52*a* having an enlarged width and into which the mooring cable 3 is inserted. As shown in FIG. 5, the mooring cable 3 is inserted into a plurality of sleeves 52. Each sleeve 52 may be separately fixed to the mooring cable 3, or arranged on the mooring cable 3 in a manner movable in a certain range.

As shown in FIGS. 6A and 6B, the sleeve 52 includes, for instance, cylinders 52*b* into which the mooring cable 3 is inserted, and the flange 52*a* having a diameter larger than that of the cylinder 52*b*. The cylinders 52*b* are arranged on both sides of the flange 52*a* so as to stabilize the attitudes of the sleeve 52 with respect to the mooring cable 3. The flange 52*a* is a part where a pressure-receiving surface for receiving the ocean current is formed, and has a size defined according to conditions, such as the ocean current speed and the number of sleeves 52. The case of the flange 52*a* having an enlarged diameter around the entire peripheries of the cylinders 52*b* is shown. However, the flange may be formed to have a partially enlarged diameter.

In the first example shown in FIG. 6A, stoppers 52*c* are arranged above and below the entire sleeves 52 arranged on the mooring cable 3. This configuration allows the sleeves 52 to freely move between the stoppers 52*c*, and can generate a lift while maintaining the flexibility of the mooring cable 3. The stopper 52*c* is made of, for instance, metallic material or resin material, may have a configuration of sandwiching the mooring cable 3, a configuration of being fixed to the mooring cable 3 (adhered or welded), or a configuration of being wrapped with a tape-like object.

In the second example shown in FIG. 6B, the stoppers 52*c* are arranged above and below each sleeve 52 arranged on the mooring cable 3. This configuration allows each sleeve 52 to freely move between the stoppers 52*c*, and can keep the positions of the sleeves 52 within fixed ranges, and can generate a lift while maintaining the flexibility of the mooring cable 3.

Here, operations of the oceanographic information collection system according to the foregoing third embodiment are described. In FIG. 5, the floating state of the observation buoy 4 is represented by solid lines, the sinking state is represented by alternate long and short dashed lines, and the intermediate state during sinking is represented by broken lines. In each state, for the sake of description, only the sleeves 52 are represented by solid lines.

In the state of standby in the sea of the observation buoy 4, the mooring cable 3 is in a state substantially parallel to the flowing direction of the ocean current. Accordingly, the flanges 52*a* of the sleeves 52 are in a state substantially perpendicular to the flowing direction of the ocean current (indicated by solid white arrows), and in a state where a lift is hard to be generated. Accordingly, the mooring cable 3 and the observation buoy 4 hold a stable state of standby in the sea.

When the observation buoy 4 causes the hydraulic fluid to be injected into the buoyancy bag 42*a* to start floating upward, the mooring cable 3 becomes in a state inclined with respect to the flowing direction of the ocean current, the flanges 52*a* of the sleeves 52 also become in a state of inclined with respect to the flowing direction of the ocean current, and the sleeves 52 receive the ocean current to generate a lift, which lifts the mooring cable 3. Accordingly, as the observation buoy 4 floats upward, the sleeves 52 can generate the lift at the mooring cable 3, and prevent generation of a tension of the mooring cable 3 pulling the observation buoy 4 downward. Finally, as represented by the solid lines, the observation buoy 4 reaches the surface of the sea, and each sleeve 52 generates a lift FL owing to a force FT in the flowing direction of the ocean current. Accordingly, the state of the observation buoy 4 floating at the surface of the sea can be stabilized.

After the observation buoy 4 has completed data transmission, the observation buoy 4 shrinks the buoyancy bag 42*a* and sinks in the sea. At this time, the sleeves 52 generate the lift FL. However, as the observation buoy 4 is sinking, the sleeves 52 sequentially changes the attitudes so as to turn with respect to the flowing direction of the ocean current in an order from the upper sleeve 52 as represented by the intermediate state in the diagram. Accordingly, the lifts of the sleeves 52 gradually decrease. When the sleeves 52 have downward attitudes, the sleeves 52 generate a force in a direction of causing the mooring cable 3 to sink. Accordingly, change in the attitudes of the sleeves 52 can be accelerated, which gradually reduces the lift, and can smoothly sink the observation buoy 4. Finally, the mooring cable 3 and the observation buoy 4 reach the undersea standby position and are floating there.

As with the second embodiment, in the oceanographic information collection system according to the foregoing third embodiment, the lift generation means 5 is arranged on the mooring cable 3. This arrangement can suppress generation of the tension of the mooring cable 3 that prevents the observation buoy 4 from floating upward owing to the ocean current, and smoothly float the observation buoy 4 upward.

The float 51 can generate a larger lift than the sleeves 52 do. Accordingly, for instance, the sleeves 52 may be used for an ocean current, such as the Oyashio Current, having a low speed of less than two knots. The float 51 may be used for an ocean current, such as the Kuroshio Current, having a high speed of at least two knots.

The present invention is not limited to the foregoing embodiments. It is a matter of course that various modifications including combined use of both the float 51 and sleeves 52 as the lift generation means 5 may be made in a range without departing from the spirit of the present invention.

REFERENCE SIGNS LIST

1: anchor
2: intermediate buoy
3, 21: mooring cable
4: observation buoy
5: lift generation means
41: main body
42: specific gravity adjuster
42*a*: buoyancy bag
43: antenna
44: observation unit
51: float
51*a*: wing member
52: sleeve
52*a*: flange

What is claimed is:

1. An oceanographic information collection system, comprising:

an anchor arranged on a sea bottom;

an intermediate buoy that is connected to the anchor and floats in a sea;

a mooring cable connected at one end to the intermediate buoy; and an observation buoy connected to another end of the mooring cable, wherein the observation buoy comprises: a main body having a longitudinal direction which is arranged in a flowing direction of an ocean current; a specific gravity adjuster that is arranged in the main body and comprises a buoyancy bag which is expandable and shrinkable; an antenna that is arranged on the main body and transfers data; and an observation unit that is arranged in the main body and acquires prescribed oceanographic information, and the observation buoy floats upward by expanding the buoyancy bag of the specific gravity adjuster, and the observation buoy sinks by shrinking the buoyancy bag of the specific gravity adjuster.

2. The oceanographic information collection system according to claim 1, wherein the mooring cable is connected at a position forward of a longitudinal center of the observation buoy.

3. The oceanographic information collection system according to claim 1, wherein, in the observation buoy, the specific gravity adjuster is arranged at a fore-end of the main body, and the antenna and the observation unit are arranged at an aft-end of the main body.

4. The oceanographic information collection system according to claim 1, wherein the observation buoy sinks and reaches a depth substantially identical to a floating depth of the intermediate buoy.

5. The oceanographic information collection system according to claim 1, further comprising lift generation means arranged on the mooring cable, wherein the lift generation means assists upward floating and sinking of the observation buoy.

6. The oceanographic information collection system according to claim 5, wherein the lift generation means is a float that includes an openable and closable wing member and can float in the sea, or a sleeve which includes a flange having an enlarged width and into which the mooring cable is inserted.

* * * * *